US008999134B2

(12) United States Patent
Bettelheim et al.

(10) Patent No.: US 8,999,134 B2
(45) Date of Patent: Apr. 7, 2015

(54) MANUFACTURING CARBON-BASED COMBUSTIBLES BY ELECTROCHEMICAL DECOMPOSITION OF $CO_2$

(75) Inventors: Armand Bettelheim, Beer Sheva (IL); Eli Korin, Beer Sheva (IL)

(73) Assignee: Ben-Gurion University of the Negev Research & Development Authority, Ltd., Beer Sheva (IL)

( * ) Notice: Subject to any disclaimer, the term of this patent is extended or adjusted under 35 U.S.C. 154(b) by 676 days.

(21) Appl. No.: 13/222,632

(22) Filed: Aug. 31, 2011

(65) Prior Publication Data

US 2012/0055804 A1 Mar. 8, 2012

(30) Foreign Application Priority Data

Sep. 2, 2010 (IL) ..... 207947

(51) Int. Cl.

| | |
|---|---|
| ***C25B 1/00*** | (2006.01) |
| ***C25B 3/04*** | (2006.01) |
| ***C25B 11/04*** | (2006.01) |
| ***C25B 11/14*** | (2006.01) |
| ***C25B 13/08*** | (2006.01) |

(52) U.S. Cl.
CPC ..... *C25B 3/04* (2013.01); *C25B 11/0415* (2013.01); *C25B 11/0478* (2013.01); *C25B 11/14* (2013.01); *C25B 13/08* (2013.01)

(58) Field of Classification Search
USPC ..... 205/555, 638–639
See application file for complete search history.

(56) References Cited

U.S. PATENT DOCUMENTS

| | | | | |
|---|---|---|---|---|
| 6,852,850 | B2 * | 2/2005 | Myerson et al. | 506/16 |
| 6,969,693 | B2 * | 11/2005 | Sauvage et al. | 502/159 |
| 8,721,866 | B2 * | 5/2014 | Sivasankar et al. | 205/555 |
| 2007/0160889 | A1 | 7/2007 | Korin et al. | |
| 2009/0301297 | A1 * | 12/2009 | Littau | 95/44 |
| 2010/0193370 | A1 * | 8/2010 | Olah et al. | 205/450 |

OTHER PUBLICATIONS

H. Tanaka, A. Aramata, J. Electroanal. Chem., 437 (1997) 29.
D. Moyaux, D. Peeters, P. Claes, Molten Salt Forum 5-6 (Molten salt Chemistry and Technology) (1998) 131.
J-Y. Park, E.D. Wachsman, J. Electrochem. Soc., 152 (2005) A1654.
G. Zhao, T. Jiang, B. Han, Z. Li, J. Zhang, Z. Liu, J. He, W. Wu, J. of Supercritical Fluids, 32 (2004) 287.
D.W. Dewulf, A.J. Bard, Catal. Lett., 1 (1988) 73.
R.L. Cook, R.C. MacDuff, A.F. Sammels, J. Electrochem. Soc., 135 (1988) 1470.
J.R. Stetter, Chem. Rev., 108 (2008) 352.
N. Mayo, R. Harth, U. Mor, D. Marouani, J. Hayon, A. Bettelheim, Anal. Chim. Acta, 310 (1995) 139.

* cited by examiner

*Primary Examiner* — Arun S Phasge
(74) *Attorney, Agent, or Firm* — Alston & Bird LLP

(57) ABSTRACT

Provided is a method for the electrochemical conversion of carbon dioxide to fuels. The method employs reducing $CO_2$ in an electrochemical cell using an aerogel carbon electrode and an ionic liquid membrane, thereby providing a carbon-based combustible.

15 Claims, 9 Drawing Sheets

MANUFACTURING CARBON-BASED COMBUSTIBLES BY ELECTROCHEMICAL DECOMPOSITION OF $CO_2$

FIELD OF THE INVENTION

The present invention relates to the electrochemical conversion of carbon dioxide to useful products using a cell with a gel or solid electrolyte comprising an ionic liquid.

BACKGROUND OF THE INVENTION

The conversion and utilization of carbon dioxide becomes still more important in view of its environmental significance. Electrochemical reduction of $CO_2$ provides a potential renewable route to carbon-based fuels. Largely investigated has been the electrochemical reduction of $CO_2$ in aqueous solutions, methanol and some organic aprotic solvents. The effect of the nature of electrolytic medium, electrode material and concentration of $CO_2$ on the Faraday efficiency has also been reported. Numerous catalysts have been reported for the electrochemical reduction of $CO_2$ and the products of the catalytic reduction include oxalate, CO, formate, carboxylic acids, formaldehyde, acetone, methanol, methane and ethylene.

Although water is an environmentally clean medium, its use is limited due to the low solubility of $CO_2$, the variety of products obtained during the reduction and the difficulty of products recovery. Using a cobalt porphyrin attached to glassy carbon electrode as catalyst for $CO_2$ reduction, the electrode was active for the electroreduction of $CO_2$ to CO and $H_2$ in aqueous medium with a current efficiency of CO production of 92% at −1.1 V [1]. Another alternative is the use of organic solvents, however this is prohibitive due to their toxic and hazardous nature. It has been reported that $CO_2$ can also be reduced in molten eutectic mixture of $Li_2CO_3$+$Na_2CO_3$+$K_2CO_3$ at 700° C. [2]. This medium allowed high solubility of $CO_2$ (~0.1 M). However, the current densities obtained for the reduction of $CO_2$ were very low. This was explained as being due to a reaction occurring between $CO_2$ and carbonate ions to yield $C_2O_5^{2-}$ ions which are difficult to reduce. The reduction of $CO_2$ to $O_2$ and CO in the 400-700° C. temperature range with a ceramic electrolyte has also been reported [3].

Ionic liquids are salts which are in the molten state at low temperatures (<100° C.); they are considered to be green solvents due to their very low vapor pressure and chemical inertness. High conductivity and wide electrochemical windows make them very useful electrolytes with wide potential applications. Ionic liquids were suggested for use as an electrolyte for the reduction of $CO_2$ [4]. Although the solubility of this gas is high in these solvents, supercritical $CO_2$ was supplied to the cathode, and when water was added the ionic liquid, CO and $H_2$ were obtained at the cathode and $O_2$ at the anode. A known method to overcome mass limitations of gases being reduced (such as $O_2$ in fuel cells) is by the use of gas diffusion electrodes which interface the gas, electrocatalyst and electrolyte phases. However, when a liquid electrolyte is used, the pores of the electrode at which the gas is reduced are prone to flooding. This can be overcome by using a solid polymer electrolyte, such as the perfluorosulfonate membranes (such as Nafion) used in fuel cells. This membrane has also been used for the electrochemical reduction of $CO_2$ to $CH_4$ and $C_2H_4$ [5, 6]. However, this membrane functions only in strong acidic media and very small faradaic efficiencies have been achieved for the reduction of $CO_2$ at gas diffusion electrodes [5,6]. It is therefore an object of this invention to provide a method for reducing $CO_2$ at gas diffusion electrodes with a gel or solid electrolyte comprising an ionic liquid, while avoiding the drawbacks of the previous techniques.

It is further an object of the invention to provide a method for reducing $CO_2$ at gas diffusion electrodes with an ionic liquid, trapped in a gel or membrane which serves as electrolyte. Besides the benefit of being environment friendly, these matrices will allow high $CO_2$ solubility, and relatively high conductivity even at low water content.

It is another object of this invention to provide an electrochemical cell comprising an anode and a cathode, and an electrolyte in the form of gel or membrane comprising an ionic liquid, for use in manufacturing carbon-based combustibles.

Other objects and advantages of present invention will appear as description proceeds.

SUMMARY OF THE INVENTION

The present invention provides a method for the preparation of a carbon-based combustible comprising reducing $CO_2$ in an electrochemical cell, which cell comprises an aerogel carbon electrode, an ionic liquid membrane as electrolyte, and an amino-containing organic base, such as ethylenediamine (EDA), present in the electrolyte or entrapped in the electrode. In one embodiment, a gel or membrane serves in said cell as electrolyte; in a preferred aspect of the invention, said gel or membrane comprises ionic liquid. Although the present invention uses an ionic liquid, for example such as reported in reference 4, the electrolyte in the present case is a solid matrix in which the ionic liquid is entrapped. Said ionic liquid preferably exhibits high ionic conductivity at ambient temperature and a wide electrochemical window. In the method according to the invention, said reducing $CO_2$ occurs advantageously at ambient temperature. In a preferred embodiment of the method according to the invention, said gel comprises a synthetic or natural zeolite. Said zeolite may be montmorillonite K10 or bentonite. Said ionic liquid may comprise, for example, 1-butyl-3-methylimidazolium tetrafluoroborate or other liquids based on imidazolium, pyridinium, pyrrolidinium, phosphonium, ammonium, and sulfonium cations, or inorganic (such as $BF_4$— or $PF_6$—) or organic (such as alkylsulfate and methanesulfonate) anions. In one aspect of the invention, the method for the preparation of a carbon-based combustible comprises reducing $CO_2$ in an electrochemical cell, in which a membrane serves as electrolyte. Said membrane may comprise RTV polysiloxane and ionic liquid. Said electrochemical cell, in the method of the invention, provides high current densities for $CO_2$ reduction. In a preferred embodiment, $CO_2$ is supplied to the cathode of said electrochemical cell, and water supplied as liquid or vapor to the anode. Said cathode is preferably a gas diffusion electrode at which $CO_2$ and $H_2O$ are reduced and the main products are CO and $H_2$. The main product at the anode is usually $O_2$. In one embodiment of the invention, the cathode comprises a material selected from porous copper, copper on carbon powder pressed on carbon paper (Cu/C), or porous carbon in which metallic copper is deposited. Ag is another metal which can be considered as catalyst at the cathode. Said cathode preferably comprises ethylenediamine. Certain macrocyclic compounds, such as metalloporphyrins, can be used as alternative catalysts at the cathode. The present invention makes also use of ethylenediamine as an additive to the catalyst in the cathode (Cu, Ag, or metalloporphyrin) which improves $CO_2$ reduction by increasing the current density. The anode may be a gas diffusion electrode made of commercially available Pt/C or porous carbon with deposited metallic Pt. Other water oxidation catalysts based on metal oxides, such as titanium oxide or tungsten oxide, can also be used at the anode. In a preferred embodiment, said cell is a planar cell, and the electrolyte is a gel. In a preferred embodiment of the method of the invention, the reduction current density depends linearly on the $CO_2$ concentration. In other important embodiment, the reduction current density depends linearly on the $CO_2$ concentration even in the presence of oxygen. The electrode is preferably not prone to CO poisoning, and it may comprise copper or Ag or a substrate coated with copper; the electrode or electrolyte may further advantageously comprises a catalyst dismutating superoxide ion radical produced during the reduction of oxygen; said catalyst may comprise Mn(III) porphyrin exhibiting a good solubility in said ionic liquid, for example, Mn(III) tetra(orthoaminophenyl)porphyrin. Said catalyst may be incorporated in the cathode. In a preferred aspect of the invention, provided is a method for the preparation of a carbon-based combustible comprising reducing $CO_2$ in an electrochemical cell in which a gel or membrane serves as electrolyte, further comprising ionic liquid saturated with porphyrin. In one aspect, the method of the invention comprises manufacturing CO and $H_2$.

The invention relates to an electrochemical cell comprising, beside anode and cathode, an electrolyte in the form of gel or membrane comprising an ionic liquid. Said gel preferably comprises a synthetic or natural zeolite. Said zeolite may be montmorillonite K10. Said ionic liquid may comprise 1-butyl-3-methylimidazolium tetrafluoroborate. Said membrane may comprise RTV polysiloxane and ionic liquid. The electrochemical cell according to the invention preferably exhibits a reduction current density which depends linearly on the $CO_2$ concentration even in the presence of oxygen.

In a preferred electrochemical cell according to the invention, the electrolyte is in the form of gel or membrane comprising an ionic liquid saturated with manganese porphyrin. Said ionic liquid may be entrapped in a gel or membrane, the gel comprises also of zeolite. Said ionic liquid may be, for example, butylmethylimidazolium tetrafluoroborate, and the zeolite may be montmorillonite. Said membrane may be an RTV polysiloxane-ionic liquid membrane. The preferred cell comprises EDA either in the electrolyte or entrapped in an electrode.

BRIEF DESCRIPTION OF THE DRAWINGS

The above and other characteristics and advantages of the invention will be more readily apparent through the following examples, and with reference to the appended drawings, wherein.

DETAILED DESCRIPTION OF THE INVENTION

Figure 1:
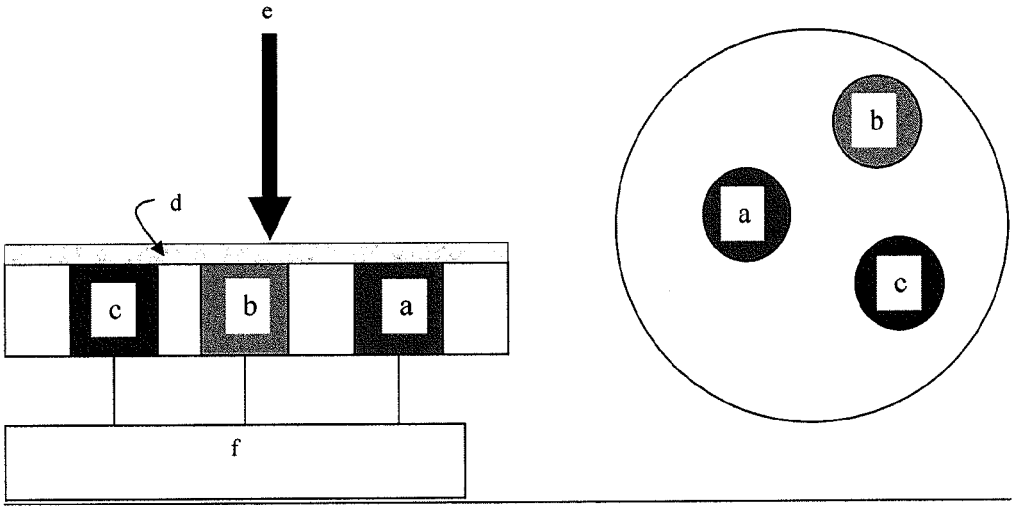
FIG. 1 shows a schematic description of a planar cell used to test the performance of the gel electrolyte. a, b and c are the working, counter and reference electrodes which are cast in polyester and coated by an ionic liquid-based gel electrolyte (d) comprised of ionic liquid (75 w/o) and zeolite (25 w/o). The potential is applied between the working and pseudo reference electrodes and the current flowing between working and counter electrodes is measured by a potentiostat (f). Pt (d=1 mm) or Cu (3×0.6 mm) are used as working electrode, graphite (d=2.5 mm) as counter and Ag (d=1 mm) as pseudo reference electrode; Gases (e) are allowed to flow near the electrolyte top surface.

It has now been found that an electrochemical cell such as described in FIG. 1 containing a gel electrolyte comprised of a zeolite mixed with an ionic liquid provides surprisingly efficient means for reducing $CO_2$ and obtaining a variety of carbon-based combustibles, particularly when the cell comprises an amine such as EDA.

In one arrangement, the electrochemical reduction of $CO_2$ leads to massive conversion of $CO_2$ to fuels such as CO and $H_2$ at the cathode, and to $O_2$ at the anode. The cell is schematically described in FIG. 10. All experiments were carried out at ambient temperature (around 25° C.).

The electrolyte employed is an ionic liquid used in its solidified form by entrapping in a gel or membrane. One of ionic liquids suitable for the present invention is butylmethylimidazolium tetrafluoroborate (abbreviated $BmimBF_4$, Fluka 91508) whose structure is shown below:

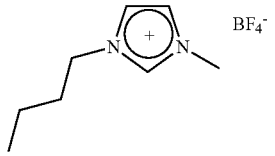

Figure 2:
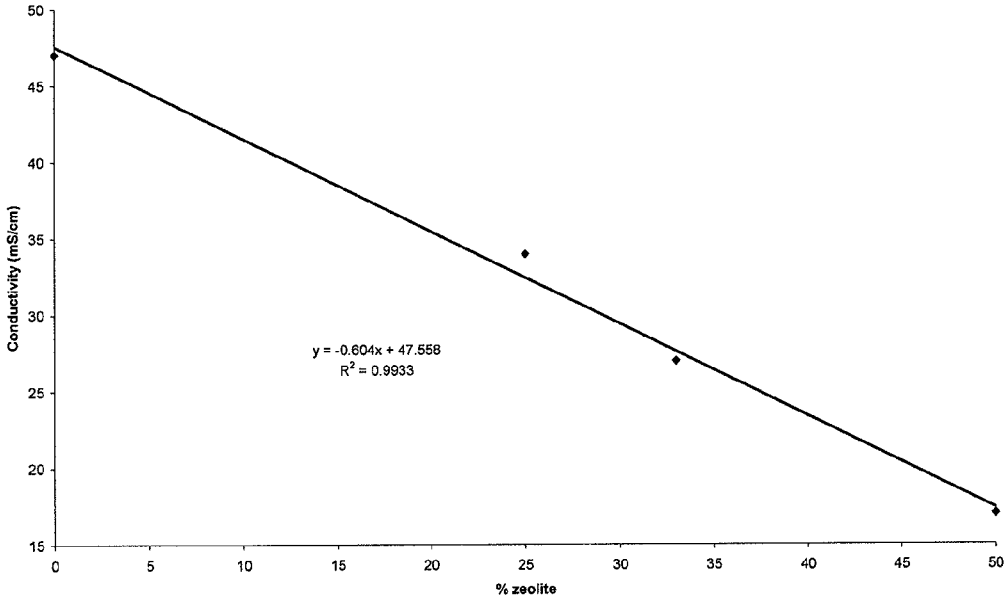
FIG. 2 shows the dependence of the conductivity of the ionic liquid gel as function of the zeolite content.

However, other ionic liquids, such as ones with other organic cations and inorganic or organic anions can be used for this purpose. The gel electrolyte used here is comprised of $BmimBF_4$ and the zeolite montmorillonite K10 (Aldrich 28, 152-2). The conductivity of this gel depends on the zeolite content as shown in FIG. 2.

Since the conductivity decreases as the concentration of zeolite increases and since concentrations of zeolite below 25% do not allow solidification of the gel, the preferred composition of the gel is: 75% ionic liquid+25% zeolite. Full gelation is obtained after an approximate period of at least one week after mixing the components. Another method of preparing a solid electrolyte in this invention is to immobilize the ionic liquid in a polysiloxane membrane, possibly according to known methods {for example, [7]). The reduction of $CO_2$ was first tested in a planar cell such as described in FIG. 1, with a drop of ionic liquid covering the three electrodes. As it can be seen from the linear sweep voltammograms in FIG. 3, the reduction wave for $CO_2$ reduction at a Pt electrode had an onset potential of −1.4 V (curve a) while two waves were observed for the reduction of $O_2$, with onset potentials of ~−0.5 and −0.75 V (curve b). However, when both gases were present as a mixture of 80% $CO_2$ and 20% $O_2$, while a wave for $O_2$ reduction with an onset potential of −0.75 V can be observed, no wave for $CO_2$ reduction was detected (curve c). This phenomenon is attributed to reaction (1) occurring in the ionic liquid: the superoxide ion obtained during the reduction of oxygen reacts with $CO_2$ and inhibits its reduction at the cathode [16].

$$O_2+2CO_2+2e \rightarrow C_2O_6^{2-} \quad (1)$$

This prevents efficient reduction of $CO_2$ if $O_2$ is present in the gas stream. This problem has been overcome in this invention by saturating the ionic liquid with the chloride salt of Mn(III) tetra(orthoaminophenyl) porphyrin (abbreviated: MnP, Midcentury, Posen, II) which structure is shown below:

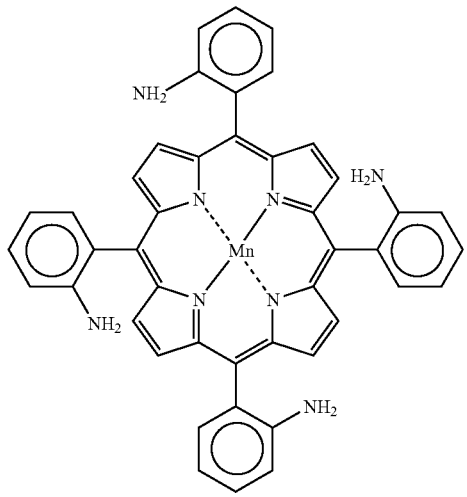

Manganese porphyrins are known to catalyze the dismutation of the superoxide ions in other media, a process with the following rate determining step:

$$Mn(III)P+O_2^- \rightarrow Mn(III)P(O_2^-) \quad (2)$$

Figure 3:
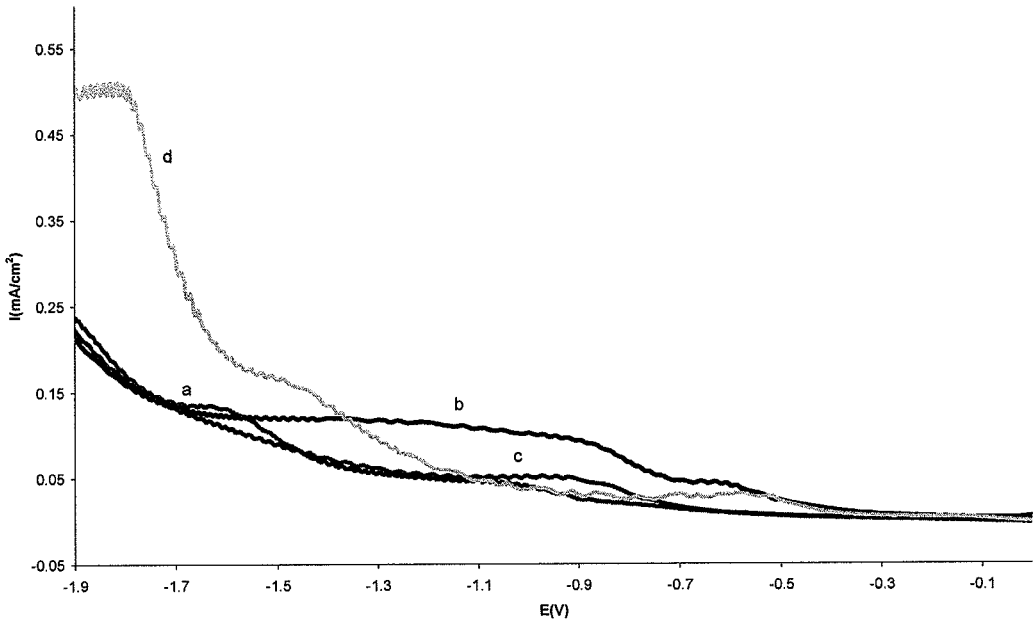
FIG. 3 shows linear sweep voltammograms obtained at a scan rate of 1 mV/s in the planar cell with a drop of ionic liquid as electrolyte covering the three electrodes and Pt as working electrode; The voltammograms are for: (a) $CO_2$, (b) $O_2$, (c) 80% $CO_2$+20% $O_2$, (d) same as (c) but in the presence of Mn(III) porphyrin in the ionic liquid.
Figure 4:
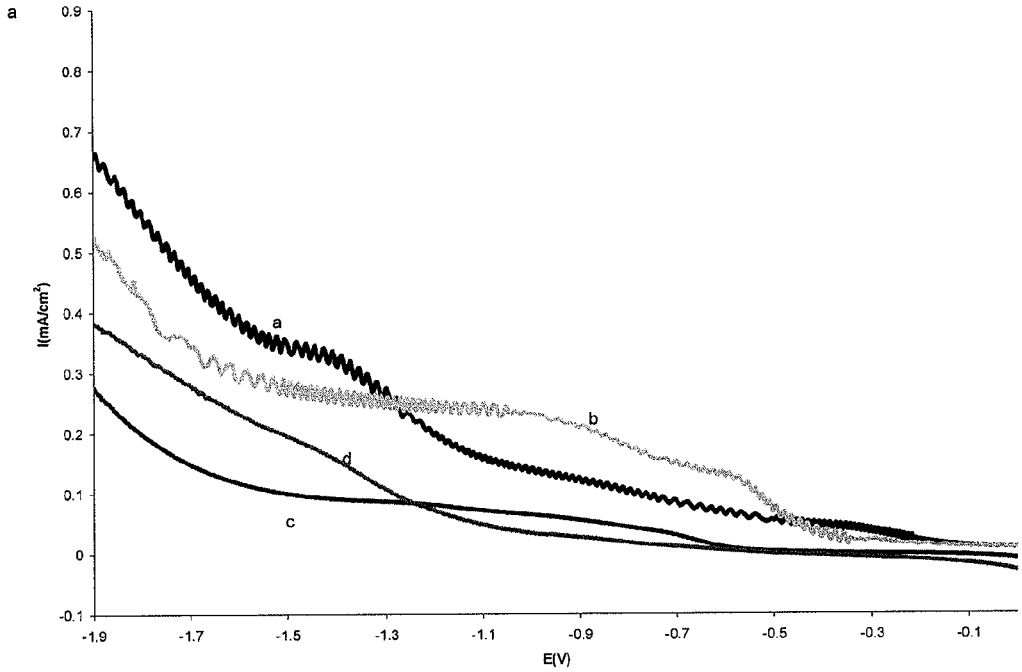
FIG. 4 shows linear sweep voltammograms obtained at a scan rate of 1 mV/s in the planar cell with a gel serving as electrolyte and comprising of ionic liquid and 25 w/o zeolite covering the three electrodes; the working electrode in this case is Pt and the voltammograms are for: (a) $CO_2$, (b) $O_2$, (c) 80% $CO_2$+20% $O_2$, (d) same as (c) but in the presence of Mn(III) porphyrin in the ionic liquid.

MnP was present in the ionic liquid, waves were observed both for $O_2$ (onset potential −0.4V) and for $CO_2$ (two waves with onset potentials of −1.2 and −1.6 V). The same experiments were repeated after replacing the ionic liquid by the gel consisting of ionic liquid and zeolite. As it can be seen from FIG. 4, the results for reducing $CO_2$ at a Pt working electrode in the absence and presence of $O_2$ were similar to those obtained with the liquid electrolyte version (FIG. 3). The onset potential for the reduction wave of $CO_2$ was −1.2V (curve a) and for $O_2$: −0.45 and −0.75 V (curve b). When the two gases were present, $O_2$ reduction was observed (onset potential −0.6 V) while no wave for $CO_2$ was detected (curve c). $CO_2$, in the presence of oxygen, can be reduced only if MnP is present in the gel (the MnP is first dissolved in the ionic liquid before mixing with the zeolite): a reduction wave with an onset potential of −1.2 V was observed (curve d).

Figure 5:
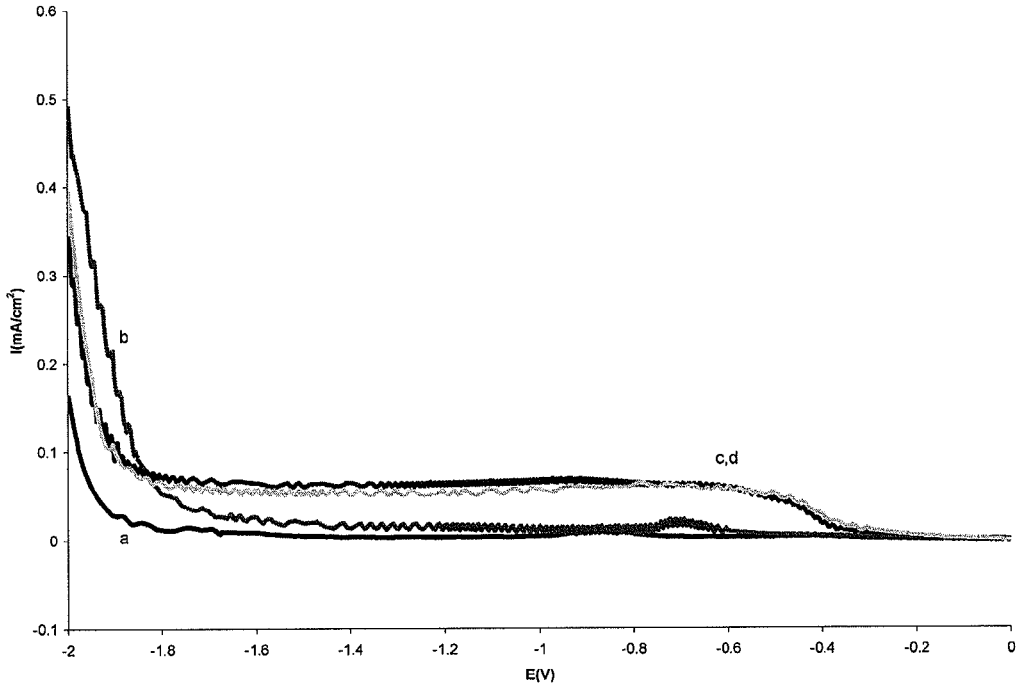
FIG. 5 shows linear sweep voltammograms obtained at a scan rate of 1 mV/s in the planar cell with a gel comprising of ionic liquid and 25 w/o zeolite covering the three electrodes; the working electrode in this case is Cu and the voltammograms are for: (a) Ar, (b) $CO_2$, (c) $O_2$, (d) 80% $CO_2$+20% $O_2$.
Figure 6:
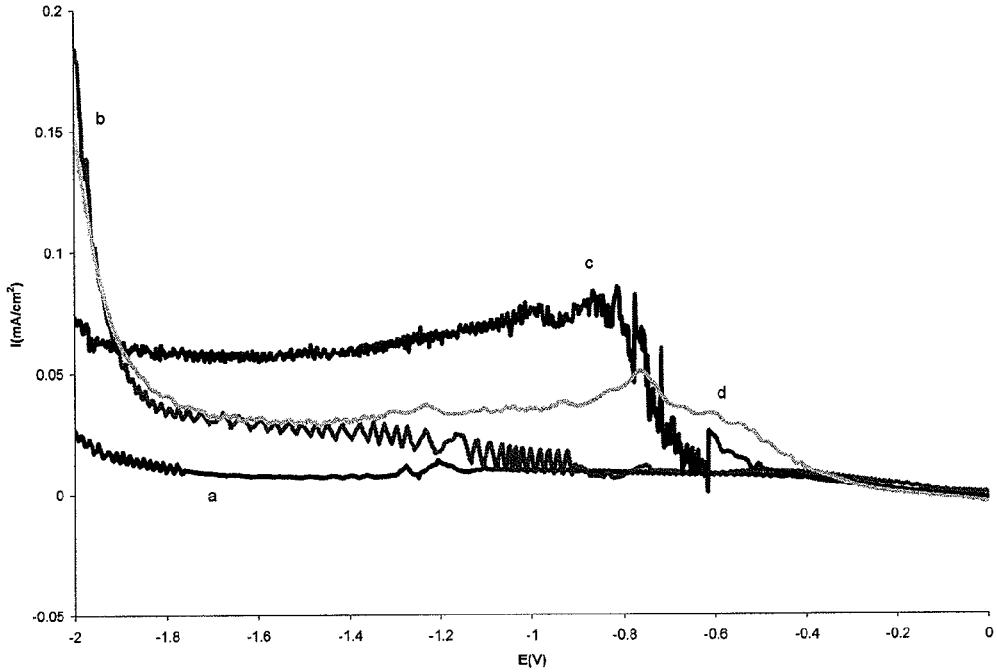
FIG. 6 shows linear sweep voltammograms obtained at a scan rate of 1 mV/s in the planar cell with a gel comprising of ionic liquid+25 w/o zeolite+Mn(III) porphyrin, covering the three electrodes; the working electrode in this case is Cu and the voltammograms are for: (a) Ar, (b) $CO_2$, (c) $O_2$, (d) 80% $CO_2$+20% $O_2$.
Figure 7:
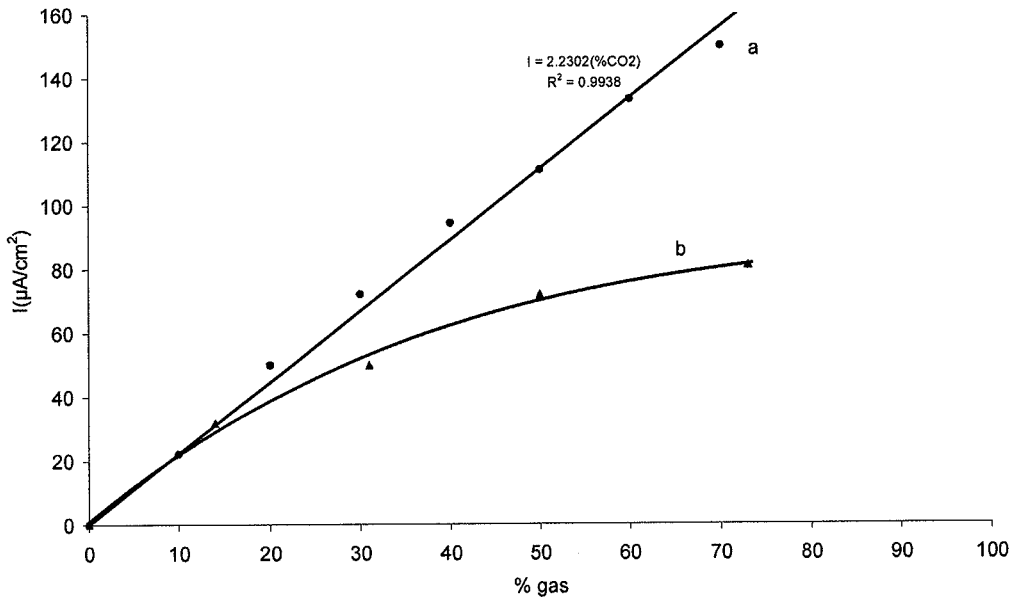
FIG. 7 shows the dependence of the current density on gas concentration for the planar cell with a gel comprising of ionic liquid and 25 w/o zeolite+Mn(III) porphyrin, covering the three electrodes for: (a) reduction of $CO_2$ at Cu at −1.8 V, (b) reduction of $CO_2$ at Pt at −1.8 V.

$CO_2$ reduction is known to be more efficient at Cu than it is at Pt electrodes [6] while Pt is used an efficient catalyst for $O_2$ reduction in fuel cells. Therefore, the abovementioned experiments were repeated with Cu working electrode in the planar cell which was coated with the gel electrolyte. As observed in FIG. 5, no reduction wave was detected in the 0 to −1.9 V range, when an inert gas (Ar) flowed near the gel surface (curve a). However, for $CO_2$ a significant increase of current was observed at potentials more cathodic than −1.7 V (curve b). For $O_2$, a wave with an onset potential of −0.4 V was obtained (curve c). Similar to the results obtained with a Pt electrode, the presence of $O_2$ inhibited $CO_2$ reduction. When MnP was included in the gel electrolyte and Cu is the working electrode, $CO_2$ reduction was observed at potentials more cathodic than −1.8 V. For $O_2$, a reduction wave with an onset potential of −0.6 V was observed. For a mixture of $CO_2$ and $O_2$, in the presence of the MnP in the gel, reduction of $CO_2$ started at an approximate potential of −1.8 V. The formation of CO during the reduction of $CO_2$ and the poisoning of the catalyst sites by adsorbed CO is avoided by using a copper electrode at which $CO_2$ is reduced and which is less prone to CO poisoning.

Figure 8:
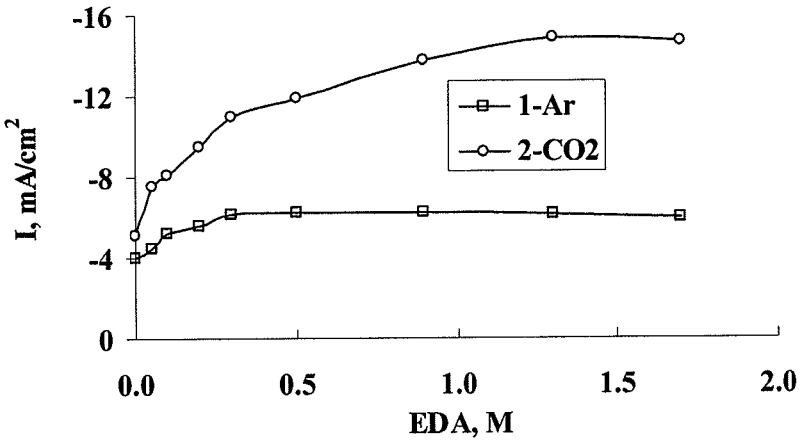
FIG. 8 shows the effect of ethylenediamine on the current density at −1.8 V (vs. Ag/AgCl/KClsatd.) for a porous aerogel carbon electrode in a solution of 0.1 M $NaHCO_3$ in which Argon or $CO_2$ is supplied at a flow rate of 100 cc/min.

It has now been found that the presence of EDA (ethylenediamine) as additive to an electrolytic solution, such as $NaHCO_3$, is efficient in increasing the current density of $CO_2$ reduction. These experiments conducted in a half-cell configuration, with porous aerogel carbon serving as working electrode and $Ag/AgCl/KCl_{satd.}$ as reference electrode, showed that the current densities for water reduction (argon flowing in solution) as well as for water+$CO_2$ reduction ($CO_2$ flowing in solution) are increased (FIG. 8). Nearly constant current densities of ~6 and 15 mA/cm$^2$ are obtained at a potential of −1.8 V for water and water+$CO_2$ reduction, respectively, at a concentration of ~1.5 Methylenediamine.

Figure 9:
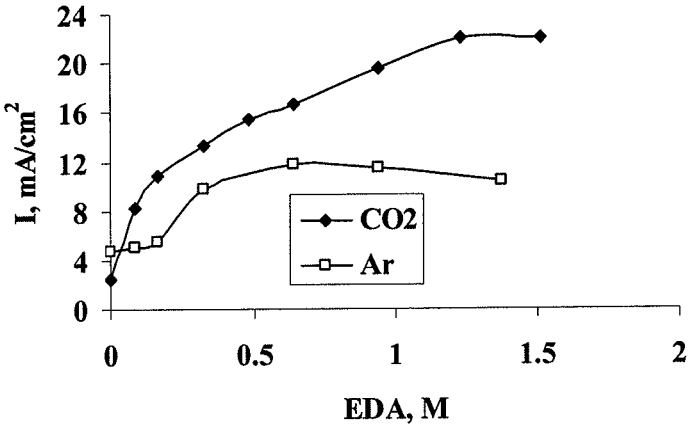
FIG. 9 shows the effect of ethylenediamine on the current density at −1.8 V (vs. Ag/AgCl/KClsatd.) for a porous aerogel carbon electrode electrolytically coated with Ag (0.5 $mg/cm^2$) in a solution of 0.1 M $NaHCO_3$ in which Argon or $CO_2$ is supplied at a flow rate of 100 cc/min.

The same experiments repeated with a Ag coated aerogel carbon working electrode (FIG. 9) showed similar results but with higher current densities: ~12 and ~22 mA/cm$^2$ at −1.8 V for water and water+$CO_2$ reduction, respectively, at a concentration of ~1.5 Methylenediamine. The rate of $CO_2$ (+water) reduction is considerably higher in the presence of this ethylenediamine concentration than that observed in the absence of the additive (~22 and ~4 mA/cm$^2$, respectively).

Figure 10:
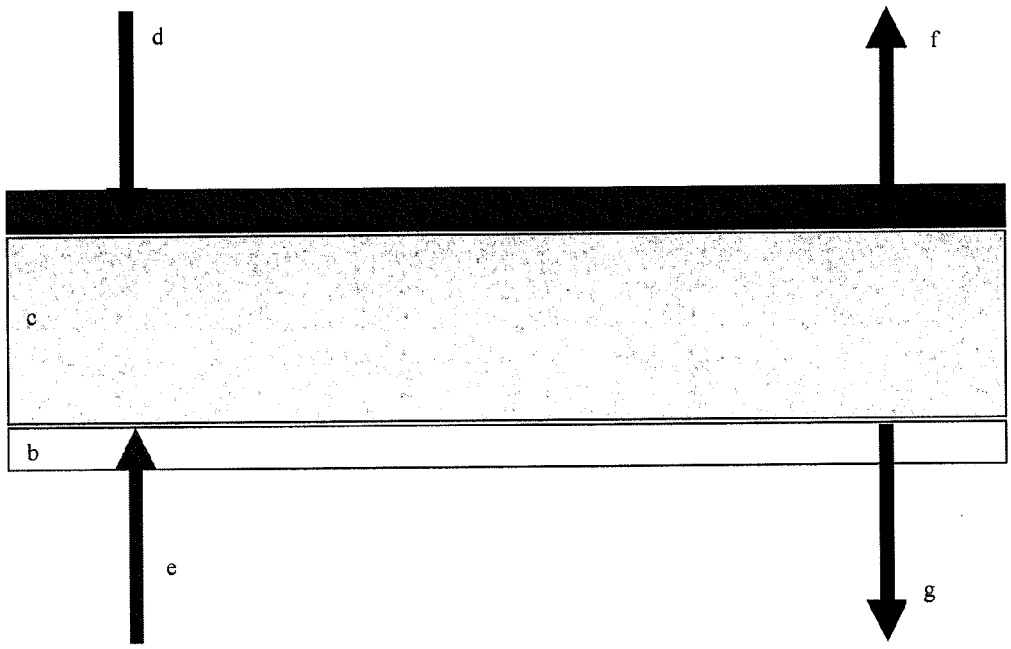
FIG. 10 shows a schematic description of the cell allowing to decompose electrochemically $CO_2$ at catalytic porous gas diffusion electrodes (a and b), and placed at two opposite sides of the membrane electrolyte (c). $CO_2$ is supplied (d) to the cathode; water as liquid or vapor is supplied (e) to the anode; the products at the cathode and anode are collected in outlets f and g, respectively.

To increase current densities and allow massive electrochemical conversion of environment benign $CO_2$ into useful energy related materials, such as CO, $H_2$ and $O_2$, a cell described in FIG. 10 was designed. In this case, gas diffusion electrodes are used as cathode and anode and are positioned in two opposite sides of a membrane serving as solid electrolyte. The performance of two membranes were tested: a commercial Nafion 117 membrane and an ionic-liquid based membrane which was developed by the present inventors, and obtained by immobilizing an ionic liquid in a room temperature vulcanized (RTV) polysiloxane matrix [7]. Although porous Cu can be used as a gas diffusion cathode, other alternatives are Cu or Ag coated on carbon powder and pressed on carbon paper (Cu/C, Ag/C) or electroless or electrolytic Cu or Ag coated on a porous carbon substrate, such as aerogel carbon (AEC). Gas diffusion anodes can be Pt/C or porous carbon electrodes (such as AEC) coated with Pt. $CO_2$ and water are supplied to the cathode and anode, respectively, and voltage or current is applied using a power supply. The membrane can be used in an acidic (Nafion) or non-acidic (the membrane developed by the present inventors) form. The reactions occurring at cathode and anode for a non-acidic membrane are as follows:

Cathode:

$$CO_2+H_2O+2e\rightarrow CO+2OH— \quad (3)$$

$$2H_2O+2e\rightarrow H_2+2OH— \quad (4)$$

Anode:

$$4OH—\rightarrow O_2+2H_2O+4e \quad (5)$$

Figure 11:
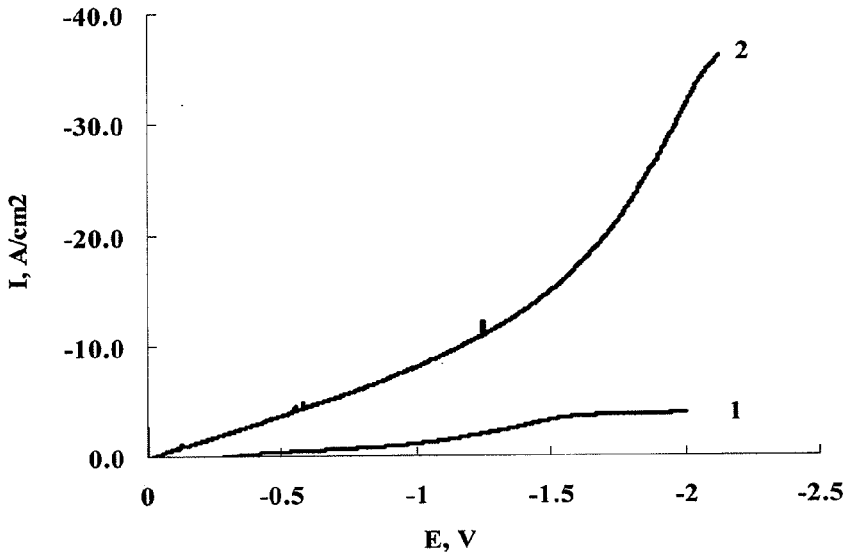
FIG. 11 shows linear sweep voltammograms obtained at a scan rate of 1 mV/s using the cell described in FIG. 10. Voltammograms 1 and 2 are obtained with a commercial Nafion 117 membrane and an RTV polysiloxane ionic liquid based membrane, respectively. The cathode and anode in the two cases are areogel carbon electrodes (A=1 $cm^2$) electrolytically coated with Ag (3 $mg/cm^2$) and Pt (2 $mg/cm^2$), respectively; $CO_2$ is supplied (10 cc/min) to the cathode and liquid water (1 cc/min) to the anode.

Typical linear sweep voltammograms obtained with the device described in FIG. 10 are shown in FIG. 11. The solid electrolyte in this case is the commercial acidic Nafion membrane (voltammogram 1) and the membrane which we have developed [7] and is used in its basic form (voltammogram 2). The cathode and anode in the two cases are AEC electrodes (Marketech), each with a geometric area of 1 $cm^2$), and electrolytically coated with the proper catalyst. The best performance was obtained with an AEC cathode coated with Ag in the presence of ethylenediamine (100 μl of a 1M aqueous solution dispersed into the electrode) and an AEC anode coated with Pt. The Ag coatings were performed by applying a potential of +0.4 V vs. for 20 mins followed by a potential of 0.2 V for 20 mins. and then 0.1 V for 20 mins. (all potentials are vs. Ag/AgCl/KClsatd.) in a solution of 1M $H_2SO_4$ containing 0.1 M $AgNO_3$. The Pt coatings were performed by applying a potential of −1 V vs. for 30 mins in solutions of 1M $H_2SO_4$ containing ~0.1 M $H_2PtCl_6$. $CO_2$ was supplied (10 cc/min) to the cathode and water (1 cc/min) to the anode. It can be seen from the voltammograms that a wave for the reduction of $CO_2$ appears with an approximate half-wave potentials of ~−1.3 V with Nafion as membrane and ~−1.9 V for the ionic liquid based membrane. Moreover, it can also be seen from FIG. 11 that higher limiting current density is obtained with the membrane we developed in comparison to that obtained with Nafion (~25 and 4 mA/$cm^2$, after background correction, respectively). As a consequence higher rates of $CO_2$ reduction, can be achieved in this device operating at ambient temperature and using the cathode catalyst (Ag in the presence of ethylenediamine) and membrane we developed.

The new technology, thus, relates to electrochemical reduction of carbon dioxide ($CO_2$). $CO_2$ diffuses preferably at ambient temperature to electrodes through an electrolyte comprising ionic liquid entrapped in a gel or membrane, the ionic liquid being preferably butylmethylimidazolium tetrafluoroborate, and the gel comprising preferably from the above ionic liquid and montmorillonite, whereas the membrane may be, for example, the RTV polysiloxane membrane, for example as described in US2007/0160889. $CO_2$ can be reduced simultaneously with $O_2$ if the ionic liquid is saturated with a manganese porphyrin.

In a preferred aspect of the invention, the technology relates to an electrochemical cell comprising i) an aerogel carbon electrode; ii) an ionic liquid gel or membrane; and iii) organic base comprising amine added in the electrolyte or incorporated in the electrode. In one preferred embodiment, said ionic liquid gel comprises 1-butyl-3-methylimidazolium tetrafluoroborate in a synthetic or natural zeolite. In another preferred embodiment, said membrane comprises RTV polysiloxane membrane and an ionic liquid.

If $CO_2$ is supplied to the cathode and water to the anode, the products are carbon based fuels (such as CO) and hydrogen at the cathode and oxygen at the anode.

The invention, thus, provides an electrochemical system for efficiently reducing $CO_2$, the system comprising an organic base comprising amine as an additive in the electrolyte or incorporated into the electrode; such base may comprise, for example, ethylenediamine (EDA) or polyethyleneimine. The effect is still stronger when aerogel carbon electrode is used as a working electrode. In a preferred embodiment, the system according to the invention comprises EDA additive, aerogel carbon electrode, Cu or Ag as a catalyst, and a ionic-liquid membrane in a gas diffusion configuration. The system exhibits great rates of $CO_2$ reduction, when compared to similar known devices which lack the above component combination.

While this invention has been described in terms of some specific examples, many modifications and variations are possible. It is therefore understood that within the scope of the appended claims, the invention may be realized otherwise than as specifically described.

REFERENCES

[1] H. Tanaka, A. Aramata, J. Electroanal. Chem., 437 (1997) 29.

[2] D. Moyaux, D. Peeters, P. Claes, Molten Salt Forum 5-6 (Molten salt Chemistry and Technology) (1998) 131.

[3] J-Y. Park, E. D. Wachsman, J. Electrochem. Soc., 152 (2005) A1654.

[4] G. Zhao, T. Jiang, B. Han, Z. Li, J. Zhang, Z. Liu, J. He, W. Wu, J. of Supercritical Fluids, 32 (2004) 287.

[5] D. W. Dewulf, A. J. Bard, Catal. Lett., 1 (1988) 73.

[6] R. L. Cook, R. C. MacDuff, A. F. Sammels, J. Electrochem. Soc., 135 (1988) 1470.

[7] E. Korin and A. Bettelheim, "Fuel Cells Membrane", US 2007/0160889 A1, Pub. Date: Jul. 12, 2007.

[8] J. R. Stetter, Chem. Rev., 108 (2008) 352.

[9] N. Mayo, R. Harth, U. Mor, D. Marouani, J. Hayon, A. Bettelheim, Anal. Chim. Acta, 310 (1995) 139.

The invention claimed is:

1. A method for the preparation of a carbon-based combustible comprising reducing $CO_2$ in an electrochemical cell which comprises an aerogel carbon electrode;

an ionic liquid gel or membrane;

an organic base comprising amine, added in the electrolyte or incorporated in the electrode, and a catalyst scavenging superoxide ion radical produced during the reduction of oxygen.

2. A method according to claim 1, wherein said ionic liquid exhibits high ionic conductivity at ambient temperature and a wide electrochemical window.

3. A method according to claim 1, wherein said reducing $CO_2$ occurs at ambient temperature.

4. A method according to claim 1, wherein said gel comprises a synthetic or natural zeolite.

5. A method according to claim 4, wherein said zeolite is montmorillonite K10.

6. A method according to claim 1, wherein said ionic liquid comprises 1-butyl-3-methylimidazolium tetrafluroborate.

7. A method according to claim 1, wherein said membrane comprises RTV polysiloxane and ionic liquid.

8. A method according to claim 1, wherein said organic base is ethylenediamine.

9. A method according to claim 1, wherein said electrochemical cell provides high current densities for $CO_2$ reduction.

10. A method according to claim 1, wherein the cathode comprises a material selected from porous copper or Ag, copper or Ag on carbon powder pressed on carbon paper (Cu/C, or Ag/C), or porous carbon in which metallic Cu or Ag is deposited, said cathode comprising ethylenediamine.

11. A method according to claim 1, wherein the anode is a gas diffusion electrode made of commercially available Pt/C or porous carbon in which metallic Pt is deposited.

12. A method according to claim 1, wherein said catalyst is Mn(III) porphyrin exhibiting a good solubility in said ionic liquid, or which can be incorporated in the cathode.

13. A method according to claim 12, wherein said porphyrin is Mn(III) tetra(orthoaminophenyl)porphyrin.

14. A method according to claim 1, comprising ionic liquid saturated with porphyrin.

15. A method according to claim 1, comprising manufacturing CO and $H_2$.

* * * * *